US005983463A

United States Patent [19]

Prentkowski et al.

[11] Patent Number: 5,983,463

[45] Date of Patent: Nov. 16, 1999

[54] LATCHPLATE OR TONGUE ASSEMBLY WITH DUAL MODE OF OPERATION

[75] Inventors: David Prentkowski, Sterling Heights; Brian Walter, Troy; Trevor Ashline, Waterford, all of Mich.

[73] Assignee: Breed Automotive Technology, Inc., Lakeland, Fla.

[21] Appl. No.: 09/098,929

[22] Filed: Jun. 17, 1998

[51] Int. Cl.[6] ..... A44B 11/10; A44B 11/25

[52] U.S. Cl. ..... 24/196; 24/625; 24/171

[58] Field of Search ..... 24/194, 191, 196, 24/163 R, 170, 171, 316, 625, 615, 640, 642

[56] References Cited

U.S. PATENT DOCUMENTS

| | | | |
|---|---|---|---|
| 4,167,054 | 9/1979 | Yamada et al. | 24/171 |
| 4,294,467 | 10/1981 | Frantom | 24/171 X |
| 5,383,257 | 1/1995 | Krauss | 24/625 |
| 5,548,879 | 8/1996 | Wu | 24/625 |
| 5,649,341 | 7/1997 | Ashline et al. | 24/196 X |

FOREIGN PATENT DOCUMENTS

| | | | |
|---|---|---|---|
| 47008 | 8/1970 | Sweden | 24/196 |

*Primary Examiner*—James R. Brittain
*Assistant Examiner*—Robert J. Sandy
*Attorney, Agent, or Firm*—Markell Seitzman

[57] ABSTRACT

A tongue (30) having multiple modes of operation comprising: a frame (60), a slide, or clamp (15) and manually adjustable knob (200). The tongue frame includes a locking feature (74) for locking engagement with a seat belt buckle (24), a seat belt receiving first aperture (66) positioned apart from the locking feature; the first aperture including a first belt clamping surface (72). The slide or clamp includes a second belt clamping surface (174) generally opposite the first belt engaging surface, the slide being arranged to slide upon the frame in the vicinity of the first aperture from a belt release position in which the seat belt is freely sliding to a belt clamping or cinching position in which the seat belt (32) is clamped or cinched between the first and second belt clamping surfaces, the slide further includes a first belt engaging surface (160) arranged to urge the slide toward its clamped position. The knob (200) is mounted upon the frame and operable to block the motion of the slide, and rotatable from an unlocked position to a locked position, wherein when in the unlocked position the slide is permitted to slide to its cinching position and when in the locked position the slide means is maintained in the release position.

16 Claims, 9 Drawing Sheets

LATCHPLATE OR TONGUE ASSEMBLY WITH DUAL MODE OF OPERATION

BACKGROUND AND SUMMARY OF THE INVENTION

The invention generally relates to a latchplate, or tongue assembly or tongue as they are also called, which is part of a seat belt safety restraint system, and more particularly to a tongue whose operation is changeable from a cinching mode of operation in which the seat belt is cinched or clamped between two relatively moveable walls to a slip mode of operation in which the seat belt is loosely received within a determinable sized opening within the tongue and during which the seat belt is generally free to slide through the opening.

Reference is briefly made to FIG. 1 which is illustrative of a typical three-point seat belt system 20. The system includes an anchor 22 coupled to a seat belt buckle 24. The buckle includes an opening to receive a tongue 30 and a latching mechanism that is typically received within a corresponding opening of the tongue. The system 20 includes a length of seat belt 32 which is arranged to define a shoulder belt portion 34 and a lap belt portion 36. The lap belt portion 36 is typically anchored to the floor by an anchor 38. The shoulder belt portion extends over a D-ring or web guide 40 and is rewound under the operation of a seat belt retractor 42. As is known in the art, the anchor 38 can be replaced by a second retractor. FIG. 1 illustrates the buckled condition of the system 20 in which the tongue 30 is received within the seat belt buckle 24. The tongue 30 will typically define the demarcation between the shoulder belt portion and the lap belt portion of the seat belt 32. When the user releases the tongue 30 from the buckle 24, the retractor 42 (or retractors) rewinds the seat belt on a spool which is part of the retractor. In this stored, rewound condition, the shoulder belt 32 will be oriented in a generally vertical configuration as also shown in FIG. 1 with the tongue 30 positioned at some location on the vertically positioned, stored seat belt webbing 32.

Safety restraint systems utilize a number of different of types of tongues. One tongue is permanently secured to the seat belt 32 at corresponding ends of the shoulder belt portion 34 and seat belt portion 36. Another type of tongue is called a "slip tongue" and includes a narrow slot through which the seat belt is received. As can be appreciated, if the lap belt portion 36 is placed under load, the shoulder belt portion 32 will slip through the tongue opening permitting the lap belt portion to enlarge. The same is true upon loading only the shoulder belt portion, that is, the lap belt portion 36 will slide upwardly through the tongue opening, permitting the length of the shoulder belt portion to increase (provided the seat belt retractor is locked). Depending upon the relative size of the seat belt slot within the tongue, the slip tongue can also be referred to as a free-falling tongue, that is, when the seat belt is retracted to its stored vertical position, the tongue 30 is permitted to fall downwardly under the influence of gravity to a fixed position. This fixed position is defined by the retractor or alternatively by a button, of known variety, which is secured to a portion of the seat belt.

Another type of tongue is referred to as a "cinching or clamping tongue." As an example, with the seat belt secured about the occupant, generally in the configuration as illustrated FIG. 1, and with loads applied to either the shoulder belt portion 34 or the lap belt portion 36, this type of tongue includes a moveable bar or slide which pinches, cinches or clamps the seat belt 32 against a cooperating surface of the tongue or latchplate. As can be appreciated, in this type of tongue, once the cinching mode of operation is activated, the transfer of the seat belt 32 between the shoulder belt portion 34 and the lap belt portion 36 is prohibited (below a definable level of applied belt force). Obviously, if the various dimensions of the internal parts of the tongue are chosen correctly, this type of cinching or clamping tongue can also operate as a free-falling tongue, after the webbing has been moved to its stored condition.

With certain types of vehicles riding over typically rough roads, the cinching type of tongue can provide for some minor discomfort to the wearer. As an example, as a stiffly sprung vehicle, such as a truck or other off-the-road vehicle rides over an extremely bumpy road, the occupant is prone to bouncing upon the seat cushion 46. A small amount of slack will be created in the seat belt 32 about the occupant's lap as the occupant bounces downwardly and compresses the cushion 46. This slack is quickly reduced by the operation of the rewind spring of the retractor 42. When the occupant returns to his or her normally seated position, the occupant will experience that the seat belt 32 has become more tightly secured about his or her body. As the vehicle progresses over the bumpy road, the seat belt will become even more tightly enveloped about the occupant, which as mentioned above, may lead to some minor discomfort.

The present invention is directed to a cinching or clamping tongue which can also operate as a slip tongue upon the activation of a manually adjustable knob or button.

Accordingly the invention comprises: a tongue having multiple modes of operation comprising: a frame, a slide (or clamp) and manually adjustable knob or button. The tongue frame includes a locking feature for locking engagement with a seat belt buckle, a seat belt receiving first aperture positioned apart from the locking feature; the first aperture including a first belt clamping surface. The slide or clamp includes a second belt clamping surface generally opposite the first belt engaging surface, the slide being arranged to slide upon the frame in the vicinity of the first aperture from a belt release position which the seat belt is freely sliding to a belt clamping or cinching position in which the seat belt is clamped or cinched between the first and second belt clamping surfaces, the slide further includes a first belt engaging surface arranged to urge the slide toward its clamped position. The knob or locking means is mounted upon the frame and operable to block the motion of the slide, and rotatable from an unlocked position to a locked position, wherein when in the unlocked position the slide is permitted to slide to its cinching position and when in the locked position the slide means is maintained in the release position.

Many other objects and purposes of the invention will be clear from the following detailed description of the drawings.

DETAILED DESCRIPTION OF THE DRAWINGS

Figure 1:
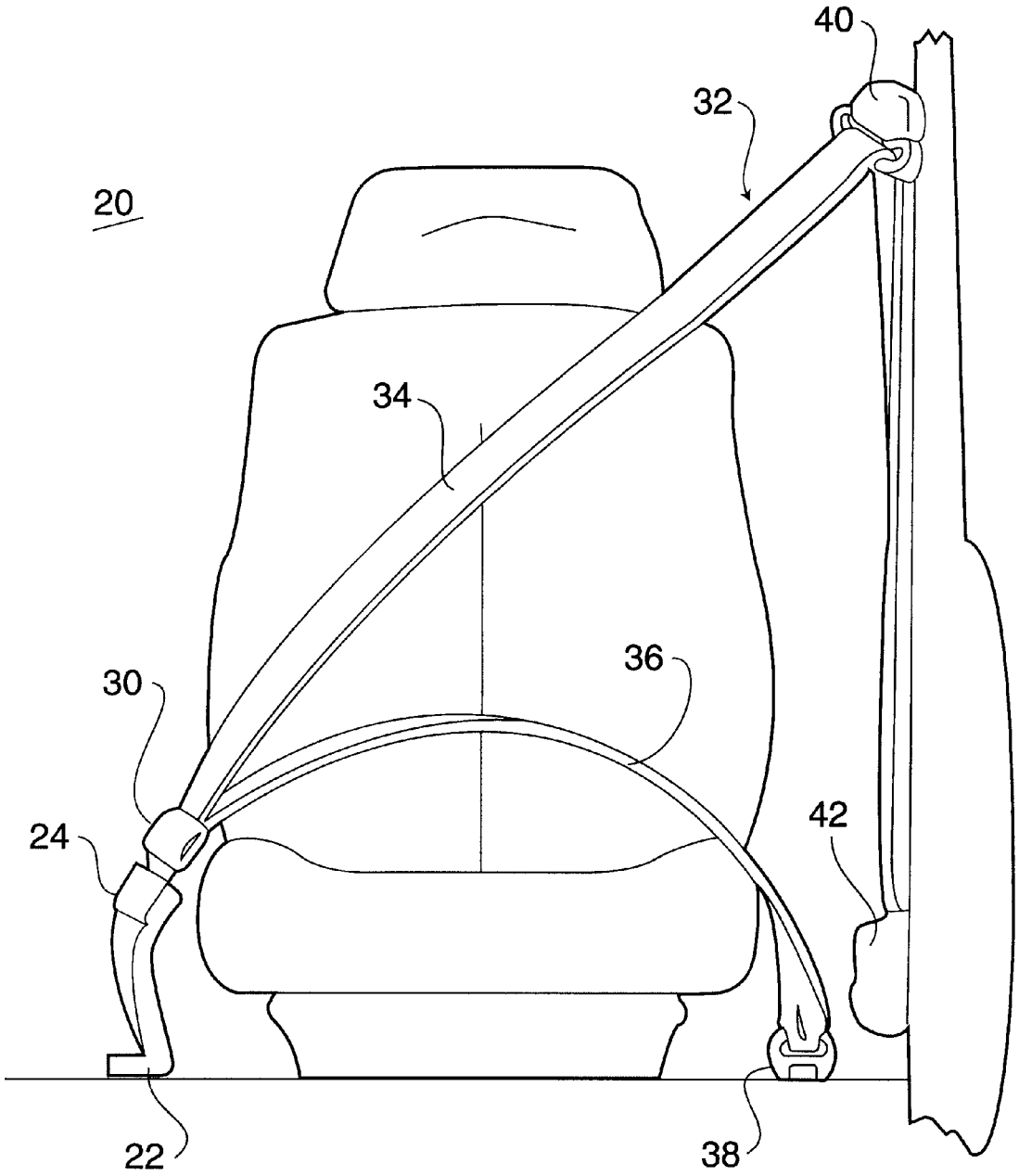
FIG. 1 diagrammatically illustrates a conventional three-point seat belt safety restraint system.

Reference is made to FIGS. 1–7 which illustrate the major components of the present invention. The latchplate (or tongue) 30 includes a metal frame 60 which includes a base portion 62 and a narrow extending tongue or tip portion 64. The base portion 62 includes an oval opening 66 and a pin opening 68. The oval opening 66 includes a first side 70 which is located closer to the tongue 64 than an opposite side 72. The tongue or tip 64 includes a lockable part which comprises an aperture 74 designed to receive a moveable latchplate (not shown) which is part of a buckle 24. As can be seen from FIGS. 1 and 5, the frame 60 is bent generally at the base (see dotted line 76) of the tongue 64.

Figure 7:
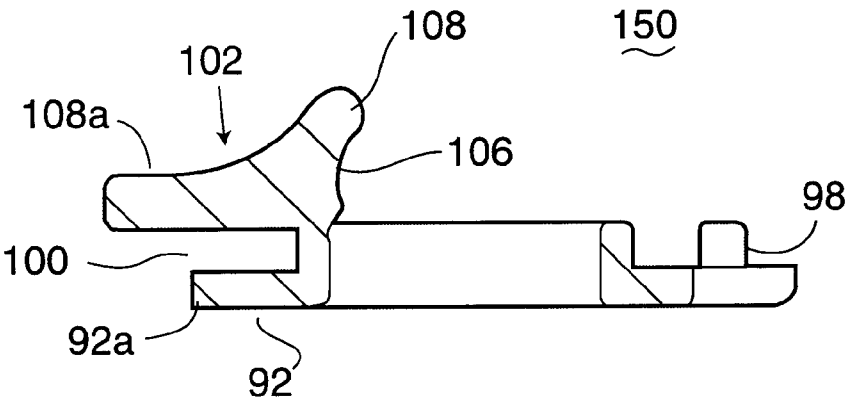
FIG. 7 illustrates a cross sectional view through section 7—7 of FIG. 6.
Figure 6:
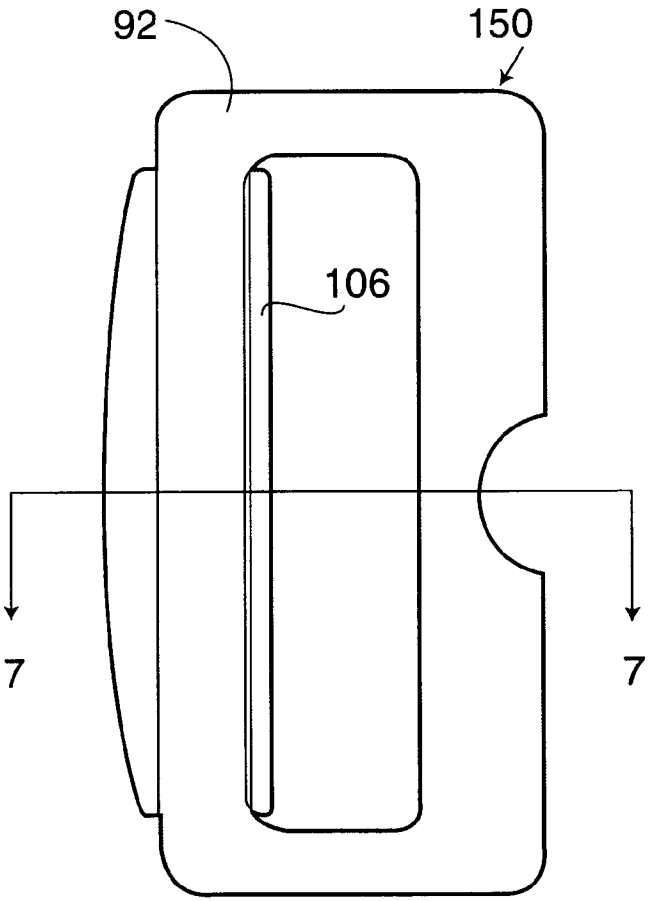
FIG. 6 illustrates a bottom plan view of an insert member.

The aperture 66 forms a seat belt receiving opening. However, to protect the seat belt from rubbing against the edges of the latchplate 30 surrounding the opening 66, the latch plate 30 further includes a typically plastic insert 90 which is also shown in FIGS. 6 and 7. The insert includes a bottom surface 92 designed to abut the lower surface 61 of the latchplate 30. The bottom 92 includes an opening 94 defined by sidewalls 96. The sidewalls 96 extend upwardly into the opening 66 and are relatively tightly positioned against the sides of the opening 66. The bottom 92 may optionally include an upwardly extending boss 98 which serves as a locating device in cooperation with a complementary-sized opening 63 of the latchplate 30. The insert includes a groove 100 which is formed between one end 92*a* of the bottom 92 and an upper walled member 102 having a laterally extending sidewall 104. The insert 90 further includes a first seat belt clamping, pinching or cinching surface 106. The clamping surface or wall 106. If the cinching surface 106 of the insert 90 were not used, the cinching surface ccan be formed by a side of the aperture such as side 72. extends laterally across opening 66. As can be seen in FIG. 7, the upper walled member 106 includes a curved tip end 108 which transitions into a smooth arcuate portion 108*a* which similarly extends laterally across opening 66 as well as opening 94. Reference is again briefly made to FIG. 3 which shows the insert 90 mounted upon the latchplate 30.

A slide assembly 150 is slidably received upon the latchplate 30 in the vicinity of the openings 66, 94. The major components of the slide assembly are a slide 162 and a manually rotatable button or knob 200.

Figure 9:
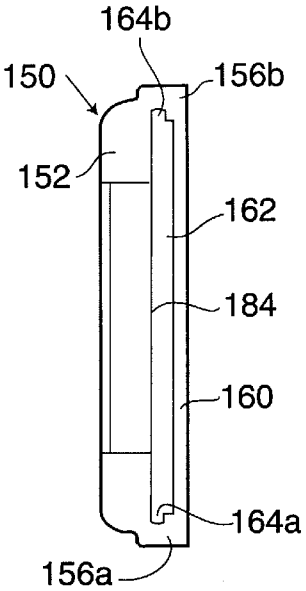
Figure 8:
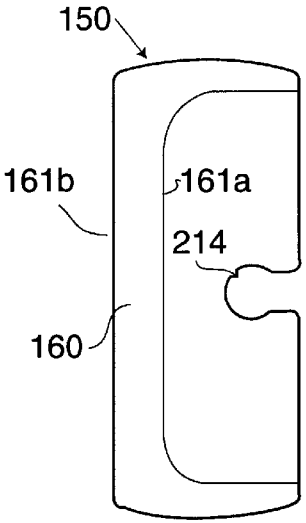

Reference is briefly made to FIGS. 8–11 which illustrate various views of the slide 152. The slide 152 includes a top 154, sides 156*a* and 156*b* and a narrow cross bar 160 which extends across the sides 156*a* and *b*. As can be seen in FIG. 9, the above components define an oval passage 162. The ends of this passage or opening 162 include outwardly extending grooves 164*a* and 164*b* which are formed within the interior walls of each respective side 156*a* and 156*b* and which slidingly receive sides 60*a,b* of the frame 60. The bar 160 includes an inner edge 161*a* and an outer edge 161*b*. The inner edge 161*a* functions as a belt engaging surface.

Figure 10:
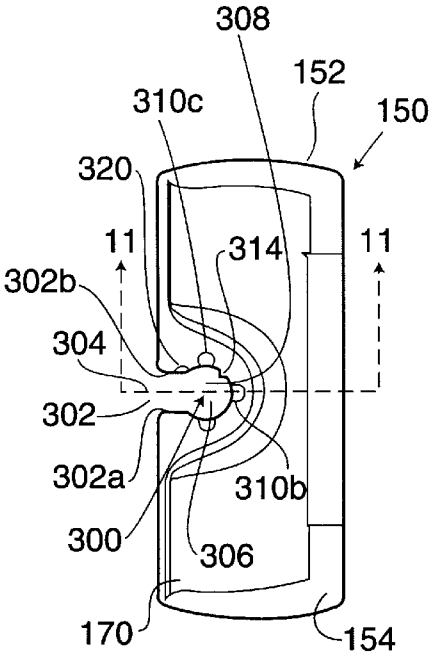
FIGS. 8, 9 and 10 respectively show a bottom plan, end and top plan view of a slide.
Figure 11:
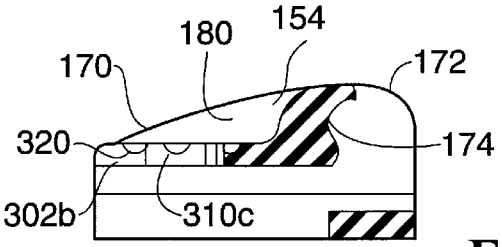
FIG. 11 is a cross sectional view taken through section 11—11 of FIG. 10.

As can be seen from FIGS. 10 and 11, the top 154 of the slide 152 is generally inclined from its front 170 towards its rear 172 to define proximate the rear 172 a wall 174 of increased height. This wall is recessed relative to the ends 172*a* and 172*b* of the rear 174 of the top surface to define a belt-receiving notch 176.

The central portion 180 of the top surface 154 of the slide 152 is recessed to define a first surface 182 which is generally parallel to a bottom surface 184 of top 154. With the slide 152 in position upon the latchplate 30, it can be seen that the first surface 182 is generally parallel to the top and bottom surfaces 65 and 61 respectively of the latchplate 30.

The wall 174 is arcuately shaped and more specifically S-shaped and defines a second clamping or cinching surface. Reference is again made to FIG. 3 which illustrates the slide positioned upon the latchplate with the slide in its release condition. The seat belt 32 is shown threaded between the insert 90, the latchplate 30 and the slide 152. When the tongue or tip 64 is inserted within the buckle 24 and the seat belt 32 loaded, the lap portion 36 of the seat belt will urge the edge 161*a* of the slide 152 in the direction of arrow 186, thereby moving the slide 152 rearwardly into clamping or cinching engagement with the seat belt 32. This clamping or cinching relationship is shown in FIG. 12.

Figure 3:
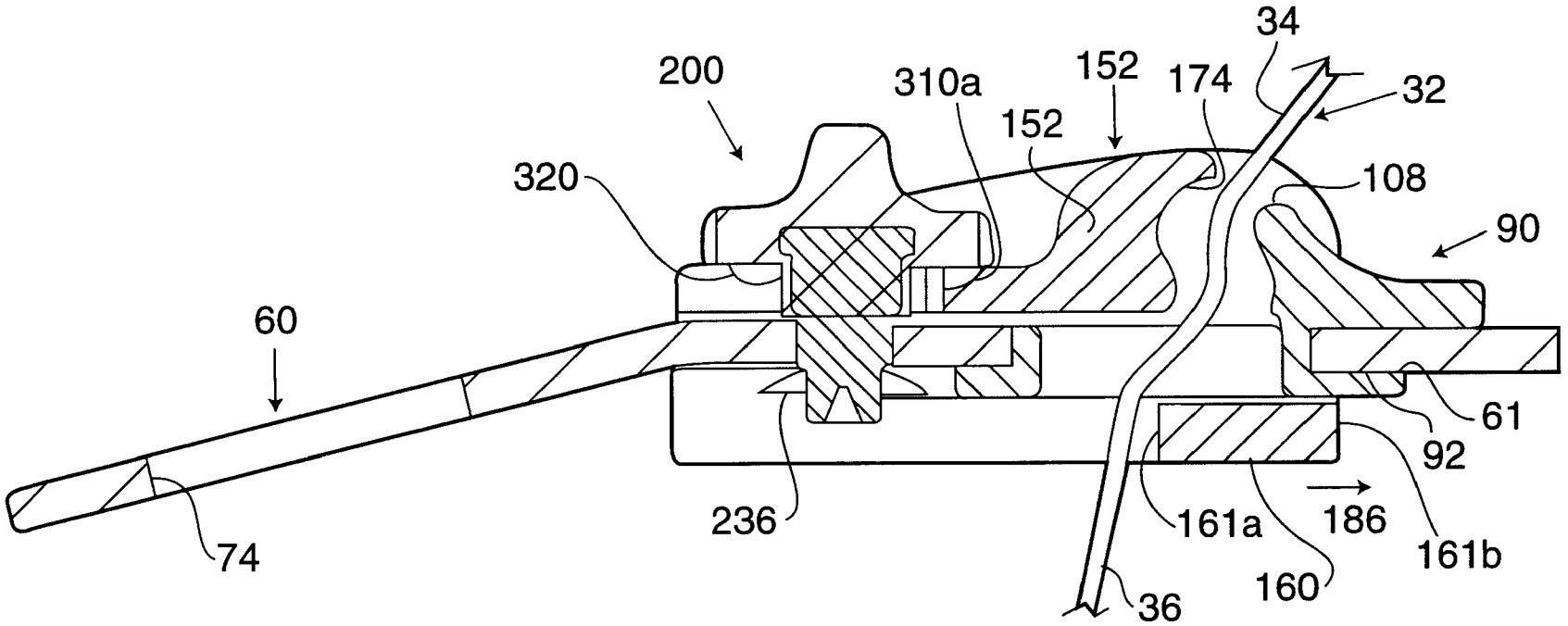
FIG. 3 is a cross sectional drawing of the tongue made in accordance with the present invention and illustrates the various components in their release position.
Figure 4:
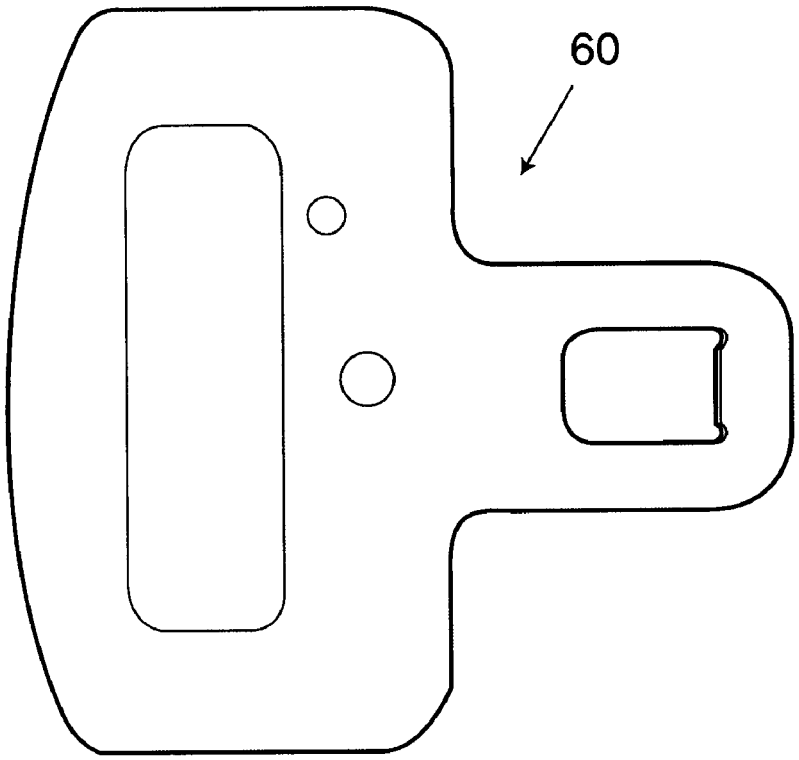
FIGS. 4 and 5 respectively illustrate a top plan view and size plan view of a latchplate frame.
Figure 5:
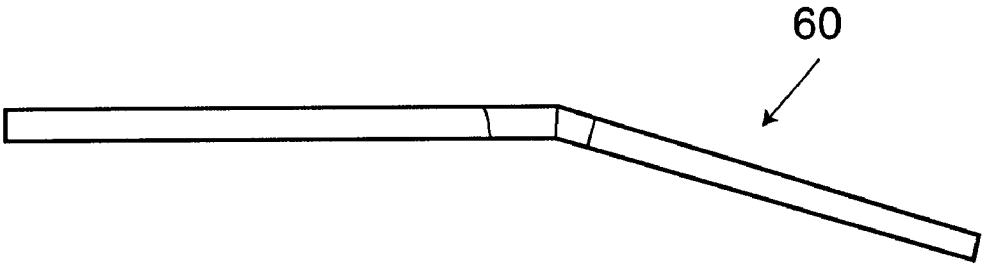
Figure 12:
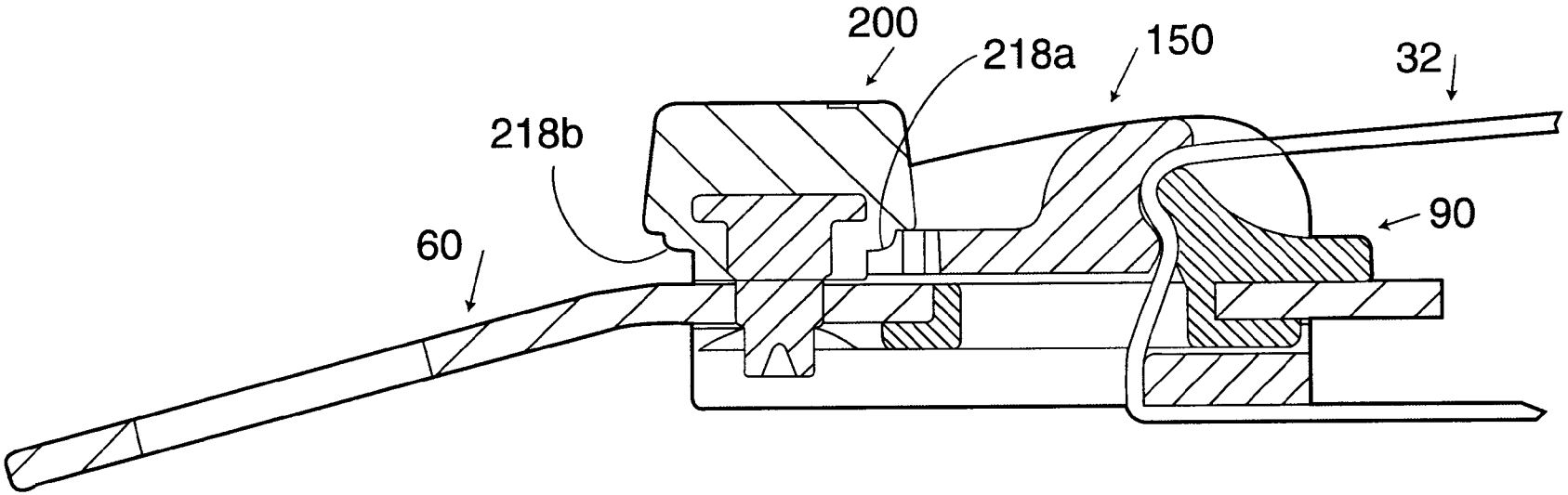
FIG. 12 illustrates the latchplate of the present invention in its cinched mode of operation.

The slide assembly 150 includes means which when manually activated prevent the slide 152 from being moved from its release position (as illustrated in FIG. 3) to its cinched or clamped position (as illustrated in FIG. 12). This means is achieved by the cooperation between the slide 152 and the knob or button 200.

Figure 15:
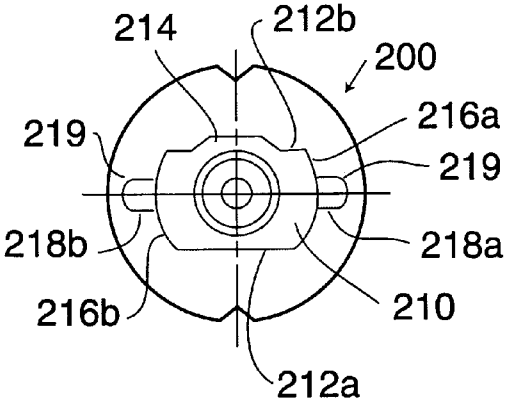
FIGS. 13, 14 and 15 illustrate a side, end and bottom view of a knob.
Figure 14:
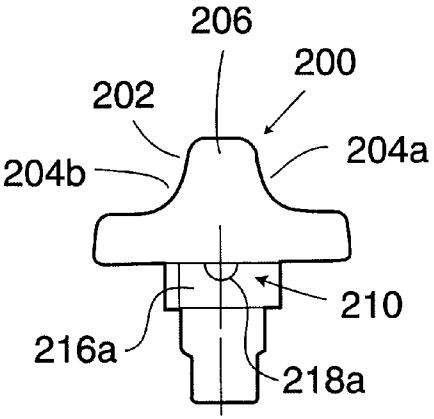
Figure 13:
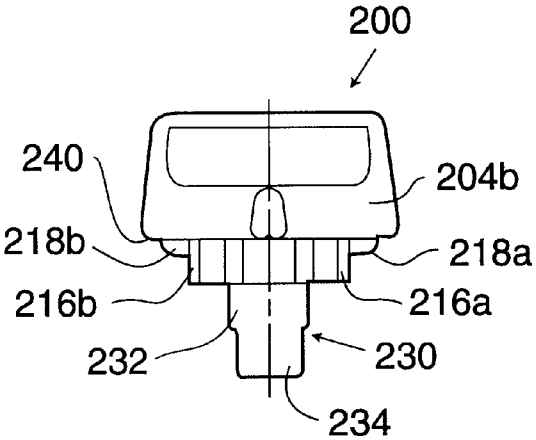

Reference is briefly made to FIGS. 13–15 and to FIG. 10. The above means is achieved by forming within the slide 152 in and about the first surface 182 a lock aperture 300. The lock aperture 300 includes a narrow slot 302 having parallel walls 302*a* and 302*b*. As can be seen in FIG. 10, the open end 304 of slot 302 provides an opening in the front 170 of the slide. The other end 306 of the slot 302 transitions into a larger diameter circular aperture 308. This aperture 308 includes a downwardly extending wall which extends to the bottom 184 of the slide 152. Located on the sides and top of the circular aperture 308 are three arcuately cup-shaped depressions 310*a*, 310*b* and 310*c* which partially extend and intersect the wall 312 of the opening 308. Positioned equidistant between the depressions 310*b* and 310*c* is a radial projection 314 which extends inwardly from wall 312. Positioned at the top of slot 302 generally near end 306 is a smaller cup-shaped depression 320 which connects from the first surface 182 through to the side wall 302*a* forming an arcuate ramp.

Figure 16:
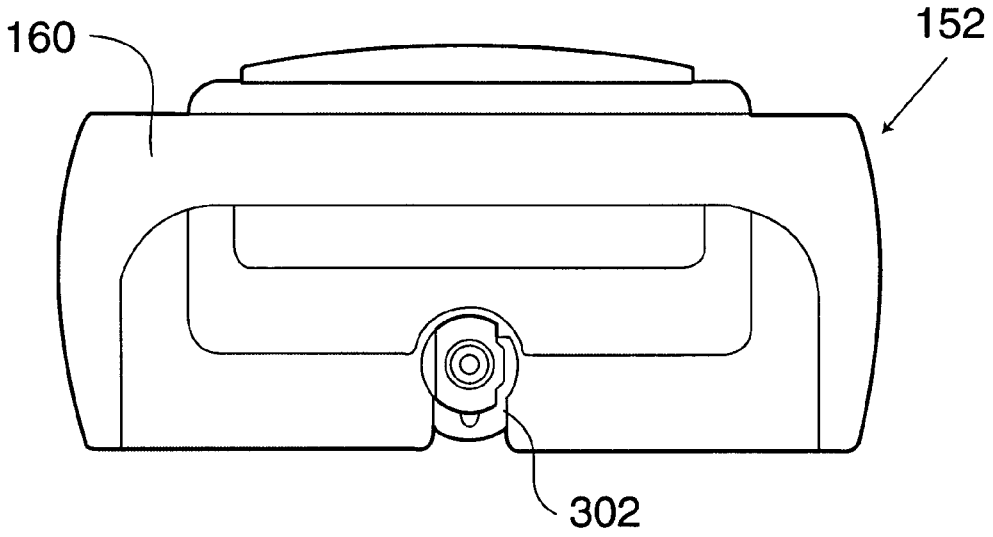
FIGS. 16 and 17 respectively illustrate the relationship between a knob and slide in their unlocked and locked conditions.
Figure 17:
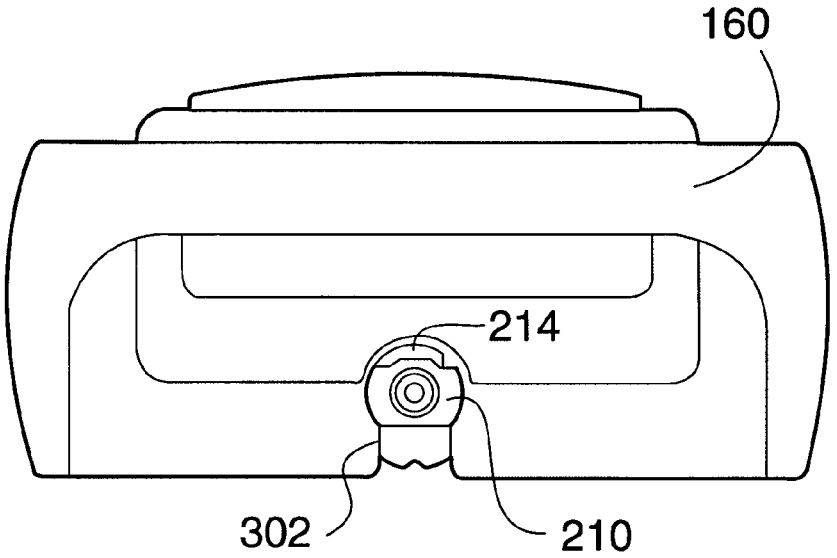

The button or knob 200, as illustrated in FIGS. 13–15, includes a manually engageable top portion 202 formed by two opposing arcuate walls 204*a* and 204*b* and a center section 206. Extending below the manually engageable portion 202 is an oval portion 210 which is formed by a first wall 212*a* and an opposing second wall 212*b*. Wall 212*b* includes an outwardly extending boss 214. The ends of the oval portion 214 are formed with arcuately, preferably circular wall segments 216*a* and 216*b*. Extending outwardly from each wall segment 216*a* and 216*b* is a respective arcuately shaped, preferably cylindrical projection 218*a* and 218*b* each having a semi-spherical tip 219. Inserted within the knob 200 is a pin 230. The pin includes a first segment 232 which is received within the pin-receiving opening 68 of the frame 60. This segment 232 of the pin 230 is slidably and rotatably received in the pin opening 68. In addition, the bottom 240 of the knob 200 is slidably received upon the top 65 of the frame 60. The knob 200 is positioned within the circular opening 308 of the slide 152. When in the cinching mode of operation, the knob is oriented such that projection 218*a* faces depression 310*b* and projection 214 faces depression 310*a* (see FIG. 17). As can be seen from FIGS. 14, 15 and 16, the width across the narrow dimension of the oval portion 210 of the knob 200 is sized to be slidably received within the narrow slot 302. FIG. 16 is a bottom plan view of the slide 152 and shows the button in its unlocked position. FIG. 17 shows the bottom 200 in its locked position.

Figure 2:
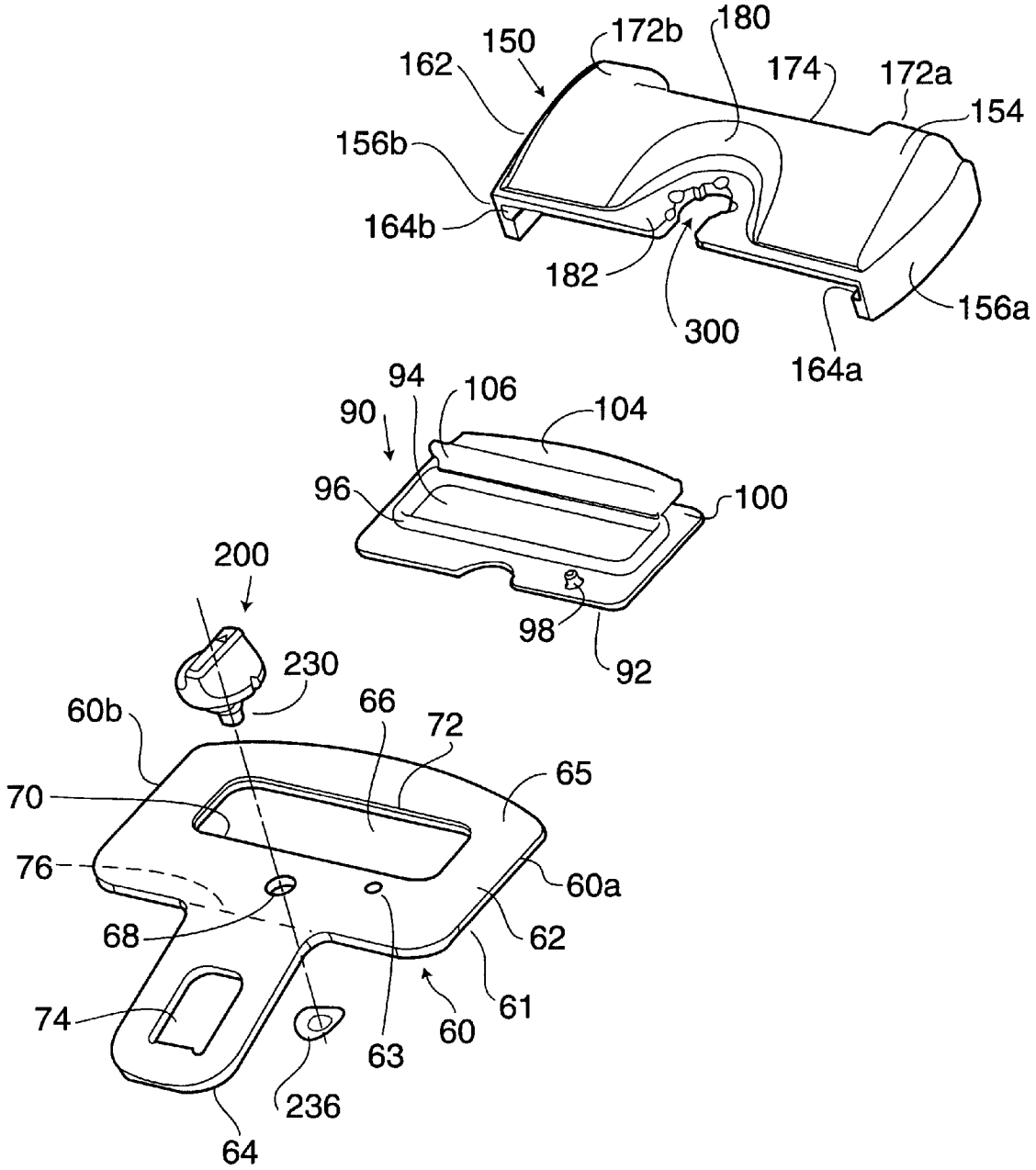
FIG. 2 is an exploded view of the present invention.

The knob pin 230 further includes a lower portion 234 which is adapted to receive a spring washer 236 (see FIGS. 2 or 3). This lower portion 234 is swaged over so as to form a rivet head to maintain the spring washer 236 in loose contact with the bottom 65*b* the frame 60.

In the above-described position of the knob 200 (see FIG. 16), the slide 152 is free to slide from its release position to its clamping position under the urging of the lap belt portion 36 of seat belt 32.

When it is desired to change the mode of operation of the tongue 30 from its cinching mode to its slip mode of operation, the user simply rotates with the knob in a clockwise direction 90 degrees as illustrated in FIG. 17. This rotation reorients the oval portion 210 of the knob so that it is positioned in a blocking relationship relative to the narrow slot 302, thereby preventing the movement of the slide 152 from its release position. As the knob 200 is rotated as described above, the lower tip 219 of projection 218*a* is caused to move into and slide upon the partial depression 320 of slide 152. The interaction between the projection 218*a* and the depression 320 permits the knob to become slightly elevated and to ride upon that portion of the first surface between the partial depression 320 and the depression 310*c*. Similarly, as the knob 200 is rotated, the other knob depression 218*b* rides upon the first surface between depression 310*b* and depression 310*a*. As the knob 200 is rotated the complete 90 degrees, the projections 218*a* and 218*b* are respectively held within the depressions 310*c* and 310*a*. As can be appreciated, the design of the slide 152 and knob 200 permits the relatively unimpeded rotation of the knob in a clockwise direction (in relation to FIGS. 9, 15 and 16).

Further, when the knob or button 200 is rotated in the clockwise direction to its locked mode, projections 218*a* and 218*c* move into depressions 310*c* and 310*a*. Due to the sharp edge contour of the depressions and the bias force of the spring 236, the button 200 is forcibly urged downwardly producing an audible click serving to identify to the user that the latchplate has been properly changed to a different mode of operation. Additionally, the movement of the projections 218*a* or *b* up over the top surface of the slide 150, coupled with forceful movement into the depressions, permits the user to actually feel that the knob or button 200 has been successfully locked into place, which also indicates the mode change. Similarly, the rotation of the button in a counter-clockwise direction causes the reverse to happen, producing another clicking sound and providing a sensory feel to the user to signal the change in the mode of the operation of the latchplate to its release or sliding mode.

Rotation of the knob 200 in a counter-clockwise direction is restricted as can be seen from the bottom view of FIG. 16. As can be seen, such rotation urges the slide 212*b* directly into the projection 320 which prohibits such movement.

Many changes and modifications in the above-described embodiment of the invention can, of course, be carried out without departing from the scope thereof. Accordingly, that scope is intended to be limited only by the scope of the appended claims.

We claim:

1. A tongue assembly having multiple modes of operation comprising:

a frame having a locking feature for locking engagement with a seat belt buckle, a first aperture positioned apart from the locking feature, the first aperture sized to receive a portion of a seat belt, the first aperture including a first belt clamping surface;

clamping means, including a second belt clamping surface generally opposite the first belt clamping surface, the clamping means arranged to slide upon the frame in the vicinity of the first aperture from a belt release position in which the seat belt is freely sliding to a belt clamping or cinching position in which the seat belt is clamped or cinched between the first and second belt clamping surfaces, the clamping means further including a first belt engaging surface arranged to urge the clamping means toward its clamped position;

locking means, mounted upon the frame and operable with the clamping means, and rotatable from an unlocked position to a locked position, wherein when in the unlocked position the clamping means is permitted to slide to its cinching position and when in the locked position the clamping means is maintained in the release position.

2. The assembly as defined in claim 1 wherein the clamping means includes a third surface generally parallel to a portion of the frame over which the clamping means slides, the third surface interrupted by an open ended lock aperture extending away from the second belt clamping surface, wherein the locking means includes a knob, manually rotatable in a preferred direction, relative to the third surface and to the lock aperture, from the unlocked position to the locked position to prevent the sliding motion of the clamping means.

3. The assembly as defined in claim 2 wherein the knob and clamping means cooperate to provide for an audible sound as the knob is rotated from one mode of operation to another.

4. The assembly as defined in claim 2 wherein the lock aperture includes a narrow slot having generally parallel facing walls, the slot including a first end intersecting with a side of the clamping means and an opposite second end, the first end defining the open end of the lock aperture, the lock aperture further including a generally circular opening adjacent the second end of the slot and contiguous therewith.

5. The assembly as defined in claim 2 wherein the knob includes a manually engageable first portion above the third surface of the clamping means, an oval portion received within the lock aperture, the oval portion slidable within the lock aperture when the locking means is in its unlocked position and with the locking means in its locked position the oval portion is movable into a position in which the lock aperture interferes with the oval portion, prohibiting the clamping means from moving to its cinching position.

6. The assembly as defined in claim 2 wherein the locking means includes a pin extending from the knob, the pin extending through a pin opening in the frame and including an extending end, a spring engageable with the extending end of the pin thereby permitting the knob to move perpendicularly relative to the third surface as it is rotated under a bias force of the spring.

7. The assembly as defined in claim 2 wherein the knob further includes a first and second arcuately shaped projection extending downward from a lower surface of the knob and positioned proximate a narrow end of the oval portion such that with the clamping means in its belt release position, rotation of the knob enables the projection to ride up upon the top of the first surface above the lock aperture, the first surface further including retaining means for receiving and retaining a respective one of the knob projections upon rotation of the knob to its unlocked position.

8. The assembly as defined in claim 7 wherein the retaining means includes two depressions located approximately 180° apart.

9. The assembly as defined in claim 8 wherein the open end of the lock aperture is formed by a slot formed by walls, and wherein an arcuate cut-out intersects a portion of the top of the third surface and one of the walls of the slot for receiving a first of the knob depressions to cause the first depression to be positioned upon the top of the first surface upon the rotation of the knob to its locked position.

10. The assembly as defined in claim 1 wherein the clamping means and the locking means cooperate to define interfering means for inhibiting the locking means from being rotated in a direction opposite a preferred direction of rotation from an initial unlocked position.

11. The assembly as defined in claim 10 wherein the clamping means and the locking means cooperate to define interfering means for inhibiting the locking means from being rotated in a direction opposite a preferred direction of rotation from an initial unlocked position, the locking means including a manually rotatable knob having projections, wherein the interfering means includes a boss radially extending into the lock aperture to locally reduce the diameter thereof, the boss interfering with the knob projections to prohibit the rotation of the knob in a non-preferred direction.

12. The assembly as defined in claim 2 wherein the knob and clamping means cooperate to cause the knob to move away from the clamping means as the knob is rotated from one mode of operation to another and then to forcefully be located into a portion of the clamping means to provide a textural indication that the knob has been moved from one mode of operation to another.

13. The assembly as defined in claim 1 including an insert (90) received with the first aperture, wherein the first belt clamping surface is formed by a surface of the insert.

14. The assembly as defined in claim 1 wherein the locking means includes a knob, and wherein the knob and clamping means cooperate to provide for an audible sound as the knob is rotated from one mode of operation to another.

15. The assembly as defined in claim 1 wherein the locking means includes a knob, wherein the knob and clamping means cooperate to cause the knob to move away from the clamping means as the knob is rotated from one mode of operation to another and then to forcefully be located into a portion of the clamping means to provide a textural indication that the knob has been moved from one mode of operation to another.

16. A tongue assembly having multiple modes of operation comprising:

a frame having a locking feature for locking engagement with a seat belt buckle, a first aperture positioned apart from the locking feature, the first aperture sized to receive a portion of a seat belt;

a first belt clamping surface about the first aperature;

clamping means, including a second belt clamping surface generally opposite the first belt clamping surface, the clamping means arranged to slide upon the frame in the vicinity of the first aperture from a belt release position in which the seat belt is freely sliding to a belt clamping or cinching position in which the seat belt is clamped or cinched between the first and second belt clamping surfaces, the clamping means further including a first belt engaging surface arranged to urge the clamping means toward its clamped position;

locking means, mounted upon the frame and operable with the clamping means, and rotatable from an unlocked position to a locked position, wherein when in the unlocked position the clamping means is permitted to slide to its cinching position and when in the locked position the clamping means is maintained in the release position.

* * * * *